US007539570B2

(12) United States Patent
Normann

(10) Patent No.: US 7,539,570 B2
(45) Date of Patent: May 26, 2009

(54) MACHINE OPERATING SYSTEM AND METHOD

(75) Inventor: James Brian Normann, Holly Springs, NC (US)

(73) Assignee: Caterpillar S.A.R.L., Geneva (CH)

( * ) Notice: Subject to any disclaimer, the term of this patent is extended or adjusted under 35 U.S.C. 154(b) by 683 days.

(21) Appl. No.: 10/872,555

(22) Filed: Jun. 22, 2004

(65) Prior Publication Data

US 2005/0283295 A1 Dec. 22, 2005

(51) Int. Cl.
*G06F 19/00* (2006.01)

(52) U.S. Cl. ..... 701/50; 37/414

(58) Field of Classification Search ..... 701/50; 180/333–334; 700/17, 83, 275; 37/414
See application file for complete search history.

(56) References Cited

U.S. PATENT DOCUMENTS

| | | | | |
|---|---|---|---|---|
| 5,188,502 | A * | 2/1993 | Tonsor et al. | 414/700 |
| 6,061,617 | A | 5/2000 | Berger et al. | |
| 6,167,337 | A | 12/2000 | Haack et al. | |
| 6,522,964 | B1 | 2/2003 | Miki et al. | |
| 6,542,789 | B2 | 4/2003 | Ufheil | |
| 2006/0129280 | A1 * | 6/2006 | Thomas et al. | 700/275 |

* cited by examiner

*Primary Examiner*—Yonel Beaulieu
(74) *Attorney, Agent, or Firm*—Finnegan, Henderson, Farabow, Garrett & Dunner

(57) ABSTRACT

A method is provided of operating a work machine having at least one work tool. The method includes sensing at least one operational characteristic of the work machine indicative of an application of the work tool. The operation of the work machine is altered in response to a new application of the work tool.

32 Claims, 4 Drawing Sheets

MACHINE OPERATING SYSTEM AND METHOD

TECHNICAL FIELD

This disclosure relates generally to a system and method for controlling a work machine, and more particularly, to a system and method for altering work machine operation based on an identified application.

BACKGROUND

Conventional work machines can be used in many different applications, including those in the areas of construction, agriculture, landscaping, and mining. To perform these applications, work tools are typically mounted to work machine lift arms or other articulated members, and may connect to one or more of the work machine's hydraulic mechanisms.

A work machine operator may drive the work machine, and control any work tools attached thereto, through the use of various operator interfaces. These operator interfaces may control hydraulic fluid flows and pressures, and may thereby control the operation of the attached work tool during performance of the application. For example, work machines may include one or more hydraulic circuits that are used to actuate various work tool lift and tilt mechanisms on the work machine. In the case of some work tools, an auxiliary hydraulic circuit may be used to control the operation of various lift and tilt mechanisms associated with that particular work tool.

It is understood that different work tools may operate at different hydraulic operating pressures and flow rates, and therefore may demand more or less from the hydraulic circuit servicing the tool. It is also understood that a single work tool may perform a number of different applications, each requiring different hydraulic operating pressures and flow rates. In addition, the hydraulic operating pressures and flow rates may also vary for a particular application based on the experience level of the work machine operator. Thus, to improve the operation of a work machine it may be necessary to identify the application being performed, and/or the operator's experience level, for each different tool attached to the work machine.

As an example, the hydraulic pressures and flow rates associated with using a bucket to dig a trench may be completely different than the pressures and flow rates associated with using the same bucket to grade a slope. The pressures and flow rates may also be different for an experienced operator versus an inexperienced operator using that same bucket. Current work machine control systems may not be capable of altering work machine operation by identifying either the application or the operator's experience level. Without recognizing these factors, the control system may not tailor the operation of a work machine from one application to the next, or from one operator to the next.

U.S. Pat. No. 6,167,337 to Haack et al. ("the '337 patent") discloses a control system for use with a work machine. The system includes a number of work controllers in communication with a control unit, and the control unit may include a processor and memory. Work controllers located on the work vehicle may send a signal to the processor indicative of the type of work vehicle that the control unit is mounted to. The processor may compare the signal to work vehicle data stored in memory and may identify the work vehicle based on this comparison. The processor may use stored application programs corresponding to the identified work vehicle in performing different tasks.

The '337 patent is generally directed to a work machine control system, but does not disclose identifying the application being performed or identifying the skill level of the operator. Accordingly, the '337 patent does not provide, for example, a strategy for altering the operation of a work machine based on either of these factors.

The present disclosure provides a work machine control system that avoids some or all of the aforesaid shortcomings in the prior art.

SUMMARY OF THE DISCLOSURE

In accordance with one aspect of the present disclosure, a method of operating a work machine having at least one work tool includes sensing at least one operational characteristic of the work machine indicative of an application of the work tool of the work machine and altering the operation of the work machine in response to a new application of the work tool.

In accordance with another aspect of the present disclosure, a method of operating a work machine having at least one work tool includes sensing at least one operational characteristic of the work machine, and altering the operation of the work machine in a manner specific to the application being performed by the at least one work tool of the machine, the altering of the operation being based on the sensing of the at least one operational characteristic of the work machine.

In accordance with still another aspect of the present disclosure, a method of operating a work machine having at least one work tool includes operating the work machine for a first work tool application, operating the work machine for a second work tool application different than the first work tool application, sensing at least one operational characteristic of the work machine during the second work tool application, and automatically performing at least one operational step of the second work tool application in a manner specific to the second application.

In accordance with yet another aspect of the present disclosure, a method of operating a work machine having at least one work tool includes operating the work machine for a first work tool application, operating the work machine for a second work tool application different than the first work tool application, sensing at least one operational characteristic of the work machine during the second work tool application, requiring operator approval to automatically alter the operation of the work machine, and automatically performing at least one aspect of the second work tool application based on the sensing of the at least one operational characteristic of the work machine.

In accordance with a further aspect of the present disclosure, a work machine operating system includes a work machine having at least one work tool, at least one sensor configured to sense at least one operational characteristic of the work machine indicative of an application of the work tool of the work machine, and a control unit configured to alter the operation of the work machine in response to a new application of the work tool.

DETAILED DESCRIPTION

Reference will now be made in detail to the drawings. Whenever possible, the same reference numbers will be used throughout the drawings to refer to the same or like parts.

Figure 1:
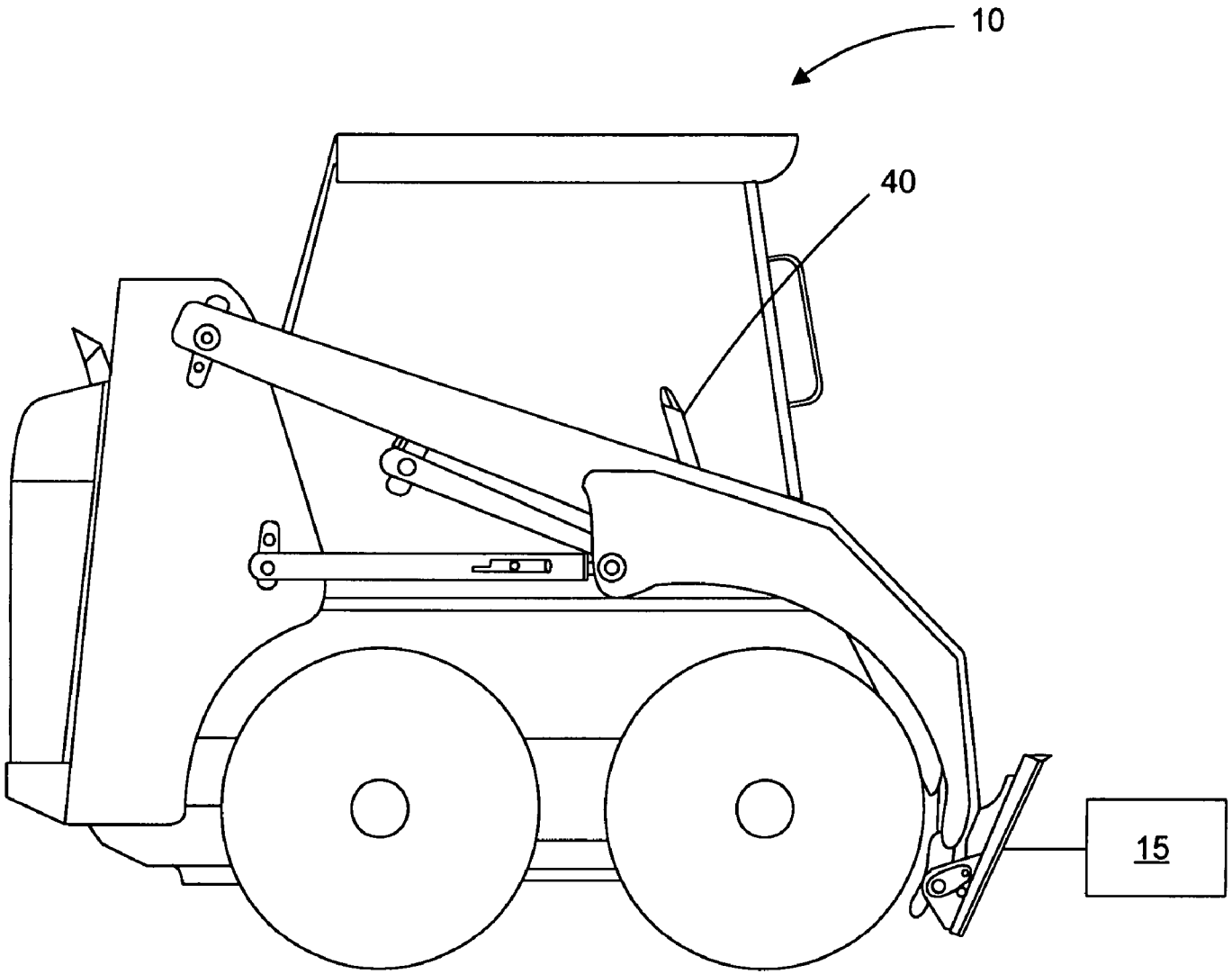
FIG. 1 is a side pictorial view of a work machine according to an exemplary embodiment of the present disclosure.

FIG. 1 illustrates a skid steer loader type work machine 10 according to an exemplary embodiment of the present disclosure. Although FIG. 1 depicts a skid steer loader, it is understood that the present disclosure may be used in conjunction with other work machines known in the art. Such work machines may include, but are not limited to, wheel dozers, wheel loaders, track loaders, backhoe loaders, compactors, forest machines, front shovels, hydraulic excavators, integrated tool carriers, multi-terrain loaders, material handlers, and agricultural tractors.

As illustrated in FIG. 1, a work tool or work implement 15 may be operatively attached to the front end of the work machine 10. It is understood that if a work machine 10 is capable of utilizing rear-mounted work tools, such tools may also be operatively attached to the back-end of the work machine 10.

In general, work tools 15 may be divided into two categories: those capable of performing a single application and those capable of performing more than one. Such so-called "single-application" work tools 15 may include, but are not limited to, trenching tools, material handling arms, augers, brooms, rakes, stump grinders, snow blowers, wheel saws, de-limbers, tire loaders, and asphalt cutters. Likewise, "multi-application" tools, may include, but are not limited to buckets, angle blades, cold planers, compactors, forks, landscape rakes, grapples, backhoes, hoppers, multi-processors, truss booms, and thumbs. In this exemplary embodiment, the work tool 15 attached to the work machine 10 may be either a single-application or a multi-application work tool 15. Moreover, the applications capable of being performed by the work tool 15 may include, but are not limited to, stockpiling, trenching, hammering, digging, raking, grading, moving pallets, material handling, snow removal, tilling soil, demolition work, carrying, cutting, backfilling, and sweeping.

Figure 2:
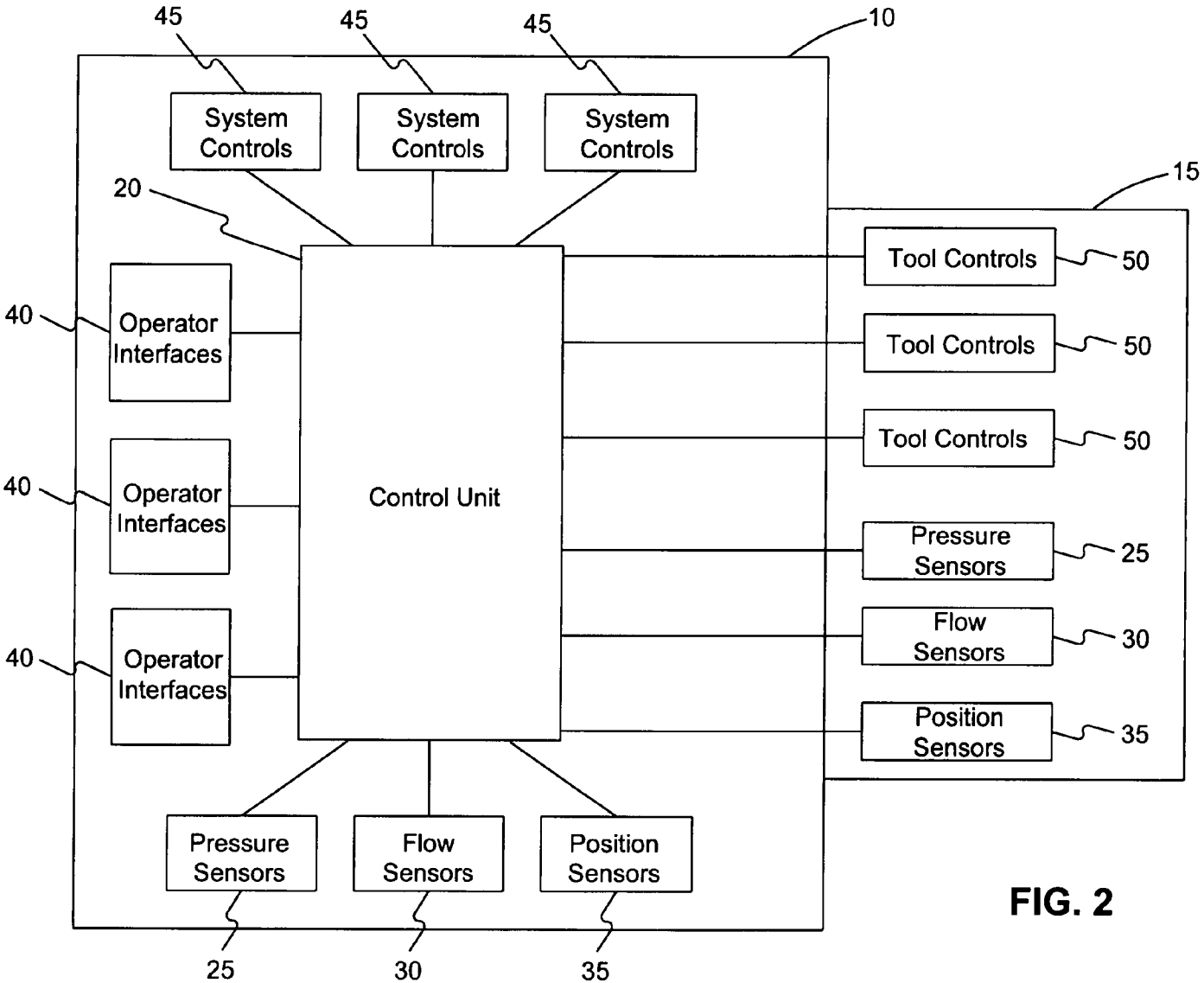
FIG. 2 illustrates a schematic representation of a work machine control system in accordance with an exemplary embodiment of the present disclosure.

FIG. 2 schematically illustrates a work machine 10 and work tool 15 in accordance with an exemplary embodiment of the present disclosure. As illustrated in FIG. 2, the work machine 10 may include a control unit 20. It is understood that the control unit 20 may be, for example, an electronic control module, a system computer, a central processing unit, or other data storage and manipulation device known in the art. The control unit 20 may collect data from the work machine 10 and/or the work tool 15, or any components thereof. The data gathered may be hydraulic pressure, hydraulic flow, work tool position, or any other data useful in determining the application being performed, the skill level of the operator, or the tool 15 being used. The data may be gathered as the work machine 10 and work tool 15 perform an application and may, thus, be gathered with respect to time. For example, if the work machine 10 utilizes a work tool 15 to perform a stump grinding application for 15 minutes, the control unit 20 may collect data in one tenth of a second intervals for the duration of the 15-minute application.

The data may be gathered using one or more pressure sensors 25, flow sensors 30, and/or position sensors 35, or other sensors or mechanisms known in the art. The sensors 25, 30, 35 may be located on either or both of the work machine 10 and work tool 15. For example, in one embodiment of the present disclosure, the pressure sensors 25 may be hydraulic fluid pressure sensors located on one or more hydraulic cylinder of the work tool 15, and may measure the pressure of the hydraulic fluid within the cylinder. The flow sensors 30 may be hydraulic fluid flow sensors fluidly connected to an auxiliary hydraulic circuit of the work machine 10, and may measure the flow of hydraulic fluid from the work machine 10 to the work tool 15. The position sensors 35 may be work tool position sensors connected to an articulating member of the work machine 10 and may measure the angular position of the articulating member. It is understood that the locations, types, and functions are merely exemplary, and that the sensors 25, 30, 35 may have locations, may be of types, and may have functions other than those listed above. For example, in some embodiments, data may also be gathered using one or more temperature, strain, acceleration, or other non-hydraulic measurement devices or sensors known in the art.

These sensors 25, 30, 35 may send the measured data to the control unit 20 at start-up of the work machine 10, and may continually measure data and send it to the control unit 20 throughout the operation of the machine. Alternatively, the sensors 25, 30, 35 may measure and send data to the control unit 20 only when such data is requested by the control unit 20. The control unit 20 may also stop measuring data at the request of the operator.

The control unit 20 may also receive data from various operator interfaces 40 used to control the work tools 15 and/or drive the work machine 10. As illustrated in FIG. 1, operator interfaces 40 are typically located in the operator compartment of the work machine 10, but can be located elsewhere. Such operator interfaces 40 may include, but are not limited to, levers, switches, buttons, foot petals, joysticks, control wheels, touchpads, LCD displays, computer screens, and keyboards.

The control unit 20 may store data received from the sensors 25, 30, 35 and the operator interfaces 40. The control unit 20 may also store data corresponding to known applications and work tools and may be capable of updating this and other data with new data. The control unit 20 may also be capable of reading data corresponding to known applications and work tools from data storage devices such as, but not limited to, compact discs, magnetic tapes or floppy discs.

The control unit 20 may also send control signals to the work machine's system controls 45. These system controls 45 may include, but are not limited to, mechanical controls, electric controls, hydraulic controls, pneumatic controls, or other controls associated with controlling or manipulating work tools 15 or other components of the work machine 10. Such system controls may be, for example, part of the work machine's primary or auxiliary hydraulic circuit, and may include electric pump motors, controllable fluid valves, etc. The system controls 45 may also include non-hydraulic system controls such as, for example, pumps, motors, and electrical devices such as electric drives, solenoids, servo motors, or other like devices. These system controls 45 may receive signals from the control unit 20 and may alter the pressure or flow of hydraulic fluid, or change the position of hydraulic cylinders, in order to control the work tool 15 attached to the machine 10.

Likewise, the control unit 20 may send signals to tool controls 50 located on the work tool 15 itself. These controls 50 on the tool 15 may be, for example, mechanical controls, electric controls, hydraulic controls, or pneumatic controls. Such controls 50 may also include, for example, electric pump motors, controllable fluid valves, electric actuators, solenoids, and/or other electric drives known in the art. Similar to the system controls 45, the tool controls 50 may receive signals from the control unit 20 and may alter the pressure or flow of hydraulic fluid, or change the position of hydraulic cylinders, in order to control the work tool 15 or other components of the work machine.

In some embodiments, an electric control (not shown) may be located on the work tool 15. The electric control may be, for example, an electronic control module, a system computer, a central processing unit, or other data storage and manipulation device known in the art. In some embodiments, the electric control may be the same as, or similar to, control unit 20. The electric control may be in communication with sensors located on the work machine 10 and/or the work tool 15 and may also be in communication with the operator interfaces 40, the work tool controls 50, and/or the control unit 20. The electric control may send and receive data between the work machine and may collect data from the sensors and/or the operator interfaces 40 and may be configured to control one or more elements of the work tool 15 such as, for example, the work tool controls 50. It is understood that in such an embodiment, altering work machine operation in response to a new or particular application of the work tool may include altering parameters on the work tool and/or an electric control located thereon.

Figure 3:
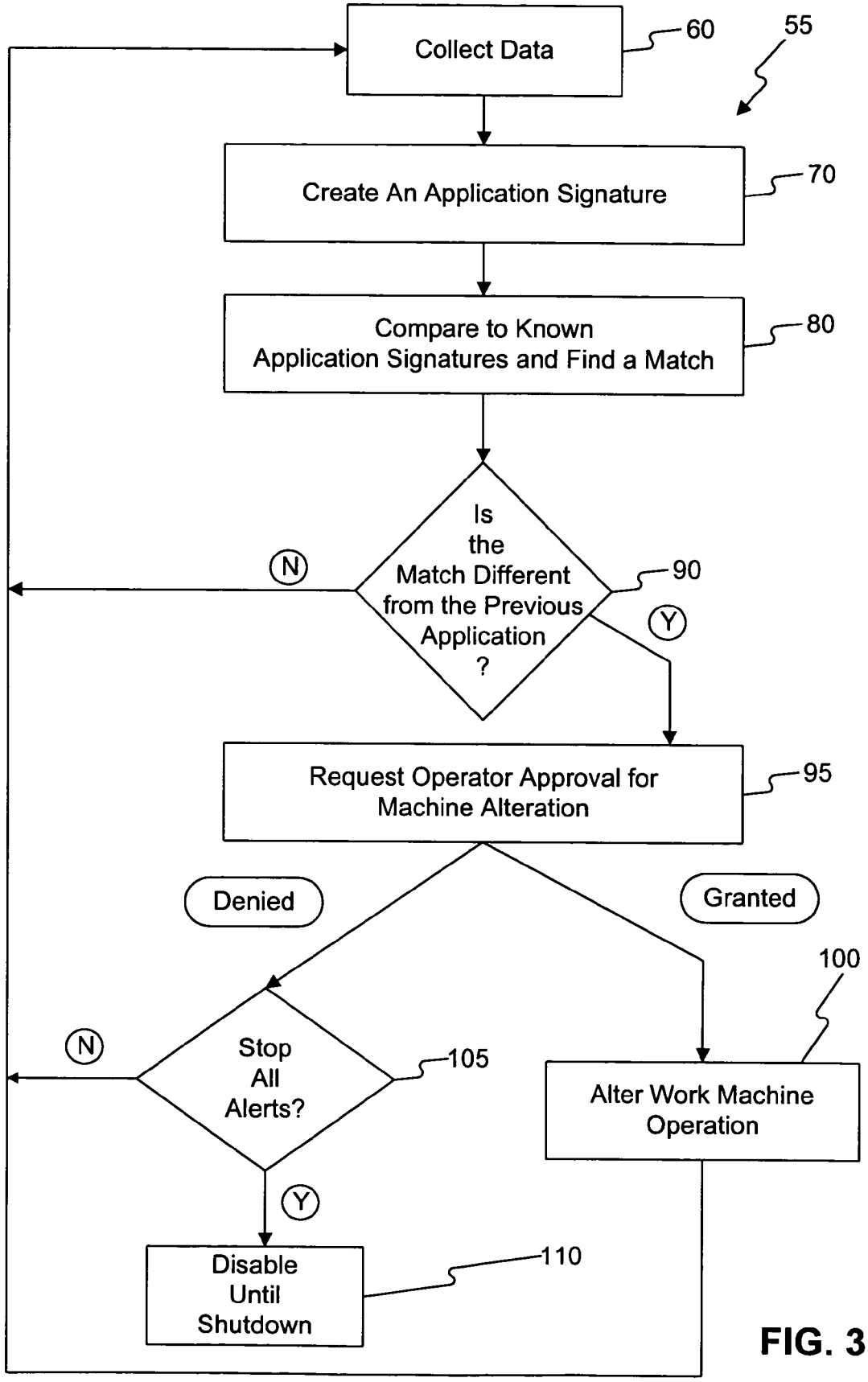
FIG. 3 is a flow chart of a work machine control strategy corresponding to an exemplary embodiment of the present disclosure.

FIG. 3 illustrates a work machine control strategy flowchart 55 according to an exemplary embodiment of the present disclosure. The control strategy may be facilitated by the control unit 20 and may be used to alter work machine operation in accordance with a particular application. As has been discussed, and as will be described in greater detail below, altering work machine operation based on the current application may include changing parameters such as, but not limited to, hydraulic cylinder priority, cylinder pressure, cylinder position, and hydraulic fluid flow. In other embodiments, altering work machine operation may also include changing one or more parameters related to controlling electric means of driving the work machine 10 and/or actuating aspects thereof. Such means may include, for example, electric drives, electric motors, solenoids and/or other electric actuators known in the art.

In some embodiments of the present disclosure, work machine alteration may occur automatically. In addition, automatic alteration of the work machine 10 may only occur after operator approval. Altering work machine operation based on at least one of the control strategies of the present disclosure may assist in maximizing work machine efficiency for an identified application. In some embodiments, work machine alterations based on these strategies may also minimize work machine wear and/or failure and may minimize the effects of improper work machine use or operation. In further embodiments, such alterations may make the work machine 10 and/or the work tool 15 more safe for operator use.

Although not explicitly depicted in FIG. 3, the control unit 20 may collect data from one or more of the sensors 25, 30, 35 and operator interfaces 40 (Step 60). The control unit 20 may use the collected data to create a calculated application signature (Step 70). As will be described below, various methods may be used to calculate the application signature. The control unit 20 may then compare the calculated signature with known application signatures (Step 80). During this comparison, the control unit 20 may access known signatures stored in its memory and find a match or identified application. The identified application may correspond to the known application signature that most closely resembles frequency, wavelength, amplitude, or other features of the calculated signature.

The control unit 20 may compare the identified application with the application previously identified (Step 90). If the identified application is not different from the previously identified application, the sensors 25, 30, 35 and the control unit 20 may continue to collect data (Step 60). If, on the other hand, the identified application is different from the previously identified application, a change in work machine operation based on the new work machine application may be required.

Before altering the operation of the work machine 10, the control unit 20 may inform the operator of the identified application, and request the operator's approval to change work machine operation for that application, using the operator interfaces 40 described above (Step 95). If approval is granted, the machine's operation will be altered to improve efficiency as described above (Step 100). Once operation has been altered, the sensors 25, 30, 35 and the control unit 20 may continue to collect data (Step 60). In a situation such as start-up where there may be no previously identified application for comparison purposes, the control unit 20 may automatically request the operator's approval to alter work machine operation.

Should the operator deny approval for altering work machine operation, the control unit 20 may ask the operator whether it should stop sending operator alerts regarding identified applications (Step 105). This may also be accomplished using the operator interfaces 40. If the operator requests that the alerts be stopped, the control unit 20 may disable the identification process until the work machine 10 shuts down, or until the operator requests that the process be resumed (Step 110). If the operator does not request that the alerts be stopped, the sensors 25, 30, 35 and the control unit 20 may continue to collect data (Step 60). It is understood that the work machine 10 may continue to operate even while the control unit 20 attempts to identify the application and while it requests and waits for input from the operator. It is also understood that the control unit 20 may identify the applications being performed by work tools 15 attached to the front-end and/or the back-end of the work machine 10.

As mentioned above, an application signature may be created in any number of ways. For example, in one embodiment of the present disclosure, the control unit 20 may gather data using the fluid pressure and work tool position sensors 25, 35 for one or more complete work cycles. A work cycle may include, for example, positioning a work tool 15, actuating it, releasing any dirt or other substances retained by it, and returning the tool 15 to its initial position. Using this data, the control unit 20 may compute the amount of energy expended by the work machine 10 during each tool 15 motion, and may form an application signature based on the energy expended as a function of time. It is understood that in each of the application identification methods utilized, the created application signature may be in the form of a vector, or any other form commonly used to represent such information. The control unit 20 may compare a vector of the application signature with vectors of other known application signatures to find an identified signature. Because the vector of the application signature may be a different size than the vectors of the known application signatures, the control unit 20 may normalize the application signature vector for comparison purposes. The normal vector of the application signature (a directional vector of a unit size one) may be created by methods known in the art, and a comparison between the normalized vectors may be done through, inter alia, the use of dot product calculations.

Still with regard to the creation of an application signature, in another exemplary embodiment of the present disclosure, the control unit 20 may utilize only data from fluid pressure sensor 25 for one or more work cycles in creating an application signature. It may then compute the force exerted during a cycle based on the information from fluid pressure sensor 25 and create an application signature based on the calculated maximum force value versus time. As described above, the control unit 20 may normalize the application signature and compare the normalized signature with other known application signatures to find a match or identified signature. It is understood that work tool position data from the position sensors 35 could also be measured in this application signature creation method to increase the speed and accuracy of the application identification.

In a further exemplary embodiment of the present disclosure, the control unit 20 may gather pressure data using pressure sensors 25 for one or more work cycles of a hydro-mechanical tool 15. In this example, pressure measurements may be taken from an auxiliary hydraulic circuit of the work machine 10 used to actuate the hydro-mechanical tool 15, and may also be taken from hydraulic cylinders, hydraulic fluid lines, or other hydro-mechanical elements located on the hydro-mechanical work tool itself. These hydro-mechanical elements may facilitate movement of parts of the work tool to perform desired tasks. Examples of such hydro-mechanical tools may include, but are not limited to, hammers, knockers, and multi-processors. These hydro-mechanical elements may require pressurized hydraulic fluid from the work machine 10 for their operation. In this embodiment, the pressure measurements may be taken at a higher sampling rate than the measurements described in previous examples.

The control unit 20 may form an application signature based on the pressure measurements as a function of time. The control unit 20 may normalize the application signature and compare the normalized signature with other known application signatures to find a match or identified signature. It is understood that hydraulic fluid flow data could also be measured upstream and downstream of the hydro-mechanical tool 15 to increase the speed and accuracy of the application identification process. It is further understood that in each of the embodiments of the present disclosure, the control unit 20 may not normalize the application signature. Instead, it may compare the calculated application signature to other known signatures to find an identified signature.

Figure 4:
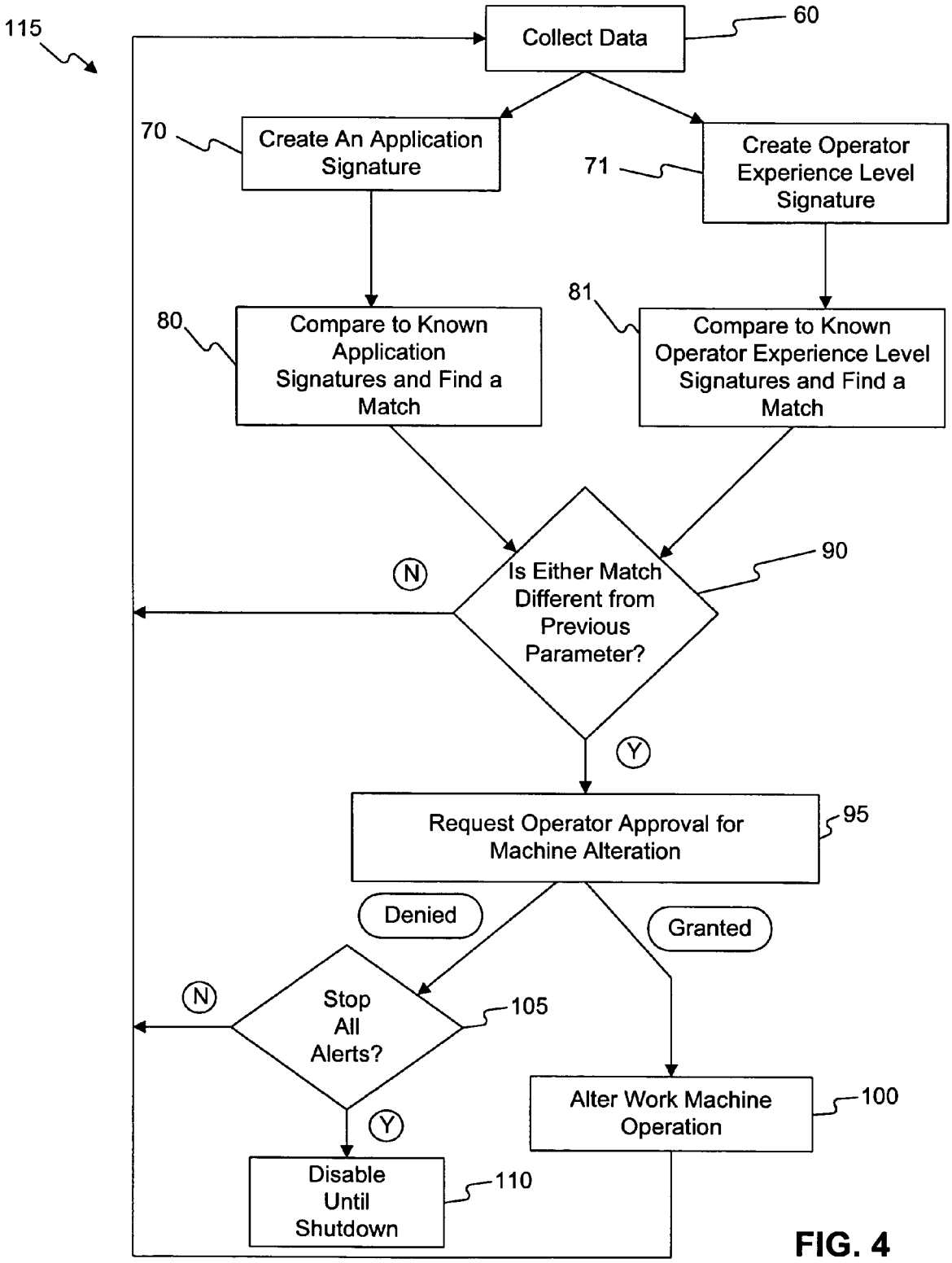
FIG. 4 is a flow chart of a work machine control strategy corresponding to another exemplary embodiment of the present disclosure.

FIG. 4 illustrates a work machine control strategy flowchart 115 in accordance with yet another exemplary embodiment of the present disclosure. The control strategy of FIG. 4 is similar to the control strategy illustrated in FIG. 3, except that in this embodiment, the control unit 20 may also identify the experience level of the operator. The experience level may be determined by requesting information directly from the operator by way of the above-mentioned operator interfaces 40. The experience level may also be determined based on measured data from fluid pressure sensors 25, fluid flow sensors 30, and work tool position sensors 35. Similar to the application identification methods described above, the control unit 20 may identify the operator experience level by creating an experience level signature (Step 71). The control unit 20 may then compare the created experience level signature with other known experience level signatures to find a match (Step 81). The match may correspond to the identified operator experience level.

The control unit 20 may then determine whether the identified operator experience level and/or the identified application signature is different from the previous operator experience level or application being performed respectively (Step 90). If either of these parameters differ from the previously determined setting, the control unit 20 may request operator approval to change the work machine's operation (Step 95). If granted, the control unit 20 may alter work machine operation based on both the identified application and the operator experience level (Step 100). If, both the identified operator experience level and the identified application signature are the same as the previous experience level and application signature respectively, the control unit 20 may continue to collect data (Step 60).

INDUSTRIAL APPLICABILITY

It is understood that the identified experience level may be used in altering work machine operation to maximize efficiency for both single-application and multi-application work tools 15. For example, a bucket (described above as a multi-application work tool) 15 may be attached to a skid steer loader 10 to perform a number of different applications. In using the bucket 15 to move a pile of stones, an inexperienced operator may consistently stop the bucket 15 too abruptly, causing stones to spill out of the bucket 15 before they are moved to their desired destination. By identifying that the operator is inexperienced, the control unit 20 of the present disclosure may change the skid steer loader's electric or hydraulic controls to reduce the bucket's lift speed while it engages the stones. The bucket's orientation may also be set based on the inexperienced operator's expected lift angle.

On the other hand, as described above, a single application work tool 15 may only be capable of performing one application. The application may, however, include several sub-applications. By measuring the hydraulic pressure, flow, or cylinder position of each sub-application, the system of the present disclosure may recognize the application being performed.

For example, a trenching tool 15 (described above as a single-application work tool) may only be capable of performing the application of digging. However, a digging application may have a number of different sub-applications, each of which may be detected by the sensors 25, 30, 35 discussed above. Thus, if the digging application requires, for example, a number of side-shifted cuts, a work machine's performance may be altered to improve efficiency by identifying these cuts and consistently putting drive force to the same side of the machine 10 as the trenching tool 15. Changing a machine's controls in this way may prevent the machine from stalling and may increase the accuracy and consistency of the cut. Such a change in work machine operation for a single-application tool may not be possible if the change was based on mere tool recognition.

In addition, experienced operators typically make different types of mistakes than inexperienced operators when operating a work machine. The system of the present disclosure may identify the type of mistake being made by the operator and may identify the operator's experience level based on mistake type. For instance, in using a single-application tool, such as a material handling arm, to lift I-beams, an inexperienced operator may stop the arm's movement too suddenly, causing an acute strain on the work machine's lift cylinder. This strain may cause a distinct signature indicative of an inexperienced operator. The control unit 20 may identify both the application and the operator's experience level based on the measurements of the sensors 25, 30, 35 discussed above, and may alter work machine operation based on both factors. It is understood that the changes in control parameters may be different for an experienced operator than for an inexperienced operator. It is further understood that altering work machine operation with respect to operator experience level may be advantageous for both single-application and multi-application work tools. Altering the operation of a work machine based on work tool recognition alone, however, may not result in the same advantages.

It is still further understood that by modifying work machine operation in this way, the control unit 20 may store data and experience level information pertaining to a particular operator and may alter work machine operation based on an operator's stored profile. This profile may be specific to the operator and may be modified as the operator's skill level changes. This profile may include pre-set experience level parameters for different applications. Such parameters may include, but are not limited to, hydraulic cylinder priority, cylinder pressure, cylinder position, and hydraulic fluid flow. The pre-set experience level parameters may be generally applied to all operators of that identified skill level when altering work machine operation for an identified application.

In embodiments of the present disclosure, the control unit 20 may be capable of identifying the work tool attached to the work machine to assist in altering the work machine's operation. This may be accomplished in a variety of ways. For example, the work machine may include a tool identification device such as, but not limited to, an optical, infra-red, or inductive sensor, and the work tool may include an appropriate signal transmitter. Once the work tool is attached to the work machine, the sensor may receive an identification signal from the signal transmitter, and send tool identification information to the control unit. It is understood that the operator may also send tool identification information to the control unit using the operator interfaces discussed above, thereby eliminating the need for a sensor and signal transmitter.

As a further example, the control unit 20 may identify the work tool 15 attached based on the pressure, flow, and/or position data measured by the sensors 25, 30, 35 already discussed. The control unit 20 may identify the tool 15 as it creates an application signature. The control unit 20 may also identify the tool 15 as it compares and/or attempts to identify an application signature. The control unit 20 may create a tool signature according to the data measured, and may then compare the tool signature with known tool signatures to find a match. Once a match is found, the control unit 20 may request that the operator confirm the identified tool 15 in addition to the identified application. It is understood that the control unit 20 may identify both the type of tool attached (i.e., a trenching tool, a rake, a fork, etc.) and the particular tool attached (i.e., a specific trenching tool according to its serial number, inventory number, or other discemable identification criteria).

Once the operator indicates that the tool 15 has been correctly identified, the control unit 20 may use the tool identification information to assist in altering the operation of the work machine 10. It may also store the tool identification information in conjunction with, for example, the number of hours the particular tool was used with the work machine. Tool identification and usage information may be retrieved and downloaded from the control unit 20 to, for example, a computer terminal or laptop for analysis.

According to one embodiment of the present disclosure, the work machine 10 may be a skid steer loader, the work tool 15 may be a trenching tool, and the control unit 20 may be an electronic control module ("ECM"). For ease of description, reference will be made to these particular devices performing a trench digging application, for the remainder of the disclosure.

When digging a trench, the ECM 20 collects pressure and position data from hydraulic pressure and cylinder position sensors 25, 35 mounted to the skid steer loader's hydraulic cylinders. The ECM 20 also collects data such as, for example, joystick position and/or joystick movement. The sensors 25,35 begin collecting data as the operator begins the first trenching motion, and continue to collect the data throughout the entire work cycle. Once the work cycle is complete, the ECM 15 creates an application signature or energy vector for each of the trenching tool's movements over time. The resulting vectors represent the amount of energy expended by the work machine 10 for each portion of the work cycle (i.e., digging, lifting the tool, returning to start, etc.). The ECM 20 then normalizes each of the energy vectors 75 and compares the normalized energy matrix to a list of known application matrices stored in its memory. Based on this analysis, the ECM 20 selects the stored application that most closely matches the calculated energy matrix. During this process, the ECM 20 also identifies the particular trenching tool 15 attached to the skid steer loader 10 using the principles outlined above.

Once an identified application has been found, the ECM 20 compares it to the last application known to be performed. If the two are the same, the ECM 20 will continue to collect data and begin the process again. If the two are different, the ECM 20 requests the operator's permission to alter the operation of the skid steer loader 10 based on the identified application. The ECM 20 may request approval, and the operator may grant or deny approval, by way of an operator interface 40 mounted in the cab of the skid steer loader 10.

If approval is granted, the ECM 20 sends signals to the skid steer loader's electric and hydraulic controls 45 to alter the machine's operation. In particular, changing the operation of the skid steer loader 10 in a trench digging application would include changing the priority control on the machine's hydraulic cylinders such that the machine swing would return to exactly the same position in each dig cycle thereby lining up the trenching tool 15 with the trench. To accomplish this, more priority in the hydraulic circuit may be placed on the swing cylinders rather than the stick cylinders. The ECM 20 would also identify the operator's experience level and use this information as a factor in the above system changes. The ECM 20 may also identify the trenching tool 15 attached to the skid steer loader 10 and use this information in altering the operation of the machine 10. Altering the skid steer loader's operation in this way may assist in maximizing skid steer loader efficiency for the trench digging application.

If the operator does not approve the request for alteration, the ECM 20 will follow up by asking the operator if it would prefer that the system cease all application identification activities. If the operator affirms, the ECM 20 will stop collecting data and be disabled until the skid steer loader 10 shuts down. If, however, the operator instructs the ECM 20 to continue, it will resume data collection and attempt to identify the application and the operator experience level again.

Other embodiments of the disclosure will be apparent to those skilled in the art from consideration of the specification and practice of the disclosure disclosed herein. For example, electric current, voltage, or resistance sensors may be used to collect data. The current, voltage, or resistance data may be used to form an application signature and/or a work tool signature, and to assist in identifying the application being performed and the tool being used. In addition, the messages, signals or requests sent by the control unit to the operator may be audible as well as visual. The work machine 10 may include a speaker or some other like device to communicate audible messages to the operator. In addition, the control strategy may also be an open-loop strategy. Moreover, a control strategy of the present disclosure may use only the experience level of the operator to alter the operation of the work machine without identifying the application being performed. Another control strategy of the present disclosure may alter work machine operation without requesting operator approval.

It is intended that the specification and examples be considered as exemplary only, with the true scope of the disclosure being indicated by the following claims.

What is claimed is:

1. A method of operating a machine having a work tool, comprising:

sensing at least one operational characteristic of the machine indicative of a first application of the work tool of the machine; and altering the operation of the machine in response to sensing at least one operational characteristic of the machine indicative of a second application of the work tool.

2. The method of claim 1, wherein the altering of the operation of the machine requires operator approval.

3. The method of claim 1, further including performing at least one operation step of the second application automatically, without operator input.

4. The method of claim 1, further including sensing at least one operational characteristic of the machine indicative of an operator experience level.

5. The method of claim 4, further including altering the operation of the machine in response to an operator experience level.

6. The method of claim 1, wherein the at least one operational characteristic of the machine indicative of the first application or the second application is measured by at least one of a fluid pressure sensor, a work tool position sensor, or a fluid flow sensor of the machine.

7. The method of claim 1, further including altering the operation of the work tool in response to a new application of the work tool.

8. A method of operating a machine having at least one work tool, comprising:

sensing at least one operational characteristic of the machine;

altering the operation of the machine in a manner specific to an application being performed by the at least one work tool of the machine, the altering of the operation being based on the sensing of the at least one operational characteristic of the machines;

creating an application signature indicative of the application being performed by the at least one work tool; and comparing the application signature to a known application signature.

9. The method of claim 8, wherein the at least one operational characteristic is indicative of an application of the at least one work tool being performed by the machine.

10. The method of claim 8, wherein the at least one operational characteristic is indicative of an operator experience level.

11. The method of claim 10, further including altering the operation of the machine in a manner specific to the operator experience level.

12. The method of claim 8, wherein the at least one operational characteristic is measured by at least one of a fluid pressure sensor, a work tool position sensor, or a fluid flow sensor of the machine.

13. The method of claim 8, wherein the altering requires operator approval.

14. The method of claim 8, further including performing at least one aspect of the application being performed by the machine automatically, without operator input.

15. The method of claim 8, further including altering the operation of the at least one work tool in response to the sensing of the at least one operational characteristic of the machine.

16. A method of operating a machine having a work tool, comprising:

operating the machine for a first application of the work tool;

operating the machine for a second application of the work tool, different than the first application;

sensing at least one operational characteristic of the machine indicative of the second application; and automatically performing at least one operational step of the second application in a manner specific to the second application.

17. The method of claim 16, further including:

sensing a plurality of operational characteristics of the machine during the second application;

creating an application signature indicative of the second application; and comparing the application signature to a known application signature.

18. The method of claim 16, wherein the performing of the at least one operational step requires operator approval.

19. The method of claim 16, wherein the at least one operational characteristic is indicative of the second application.

20. The method of claim 16, wherein the at least one operational characteristic is indicative of an operator experience level.

21. The method of claim 16, wherein the at least one operational characteristic is measured by at least one of a fluid pressure sensor, a work tool position sensor, or a fluid flow sensor of the machine.

22. The method of claim 16, further including altering the operation of the work tool in response to the sensing of the at least one operational characteristic.

23. A method of operating a machine having a work tool, comprising:

operating the machine for a first application of the work tool;

operating the machine for a second application of the work tool, different than the first application;

sensing at least one operational characteristic of the machine during the second application;

requiring operator approval to automatically alter the operation of the machine; and automatically performing at least one aspect of the second application based on the sensing of the at least one operational characteristic of the machine.

24. The method of claim 23, further including:

sensing a plurality of operational characteristics of the machine during the second application;

creating an application signature indicative of the second application; and comparing the application signature to a known application signature.

25. The method of claim 24, wherein the at least one operational characteristic is indicative of the second application.

26. The method of claim 24, wherein the at least one operational characteristic is indicative of an operator experience level.

27. The method of claim 23, wherein the at least one operational characteristic is measured by at least one of a fluid pressure sensor, a work tool position sensor, or a fluid flow sensor of the machine.

28. The method of claim 23, further including altering the operation of the work tool in response to the sensing of the plurality of operational characteristics.

29. A machine, comprising:

at least one work tool;

at least one sensor configured to sense at least one operational characteristic of the machine indicative of an application of the work tool; and a control unit configured to alter the operation of the machine in response to a new application of the work tool, wherein the at least one sensor is configured to sense at least one operational characteristic of the machine indicative of an operator experience level.

30. The machine of claim 29, wherein the control unit is configured to alter the operation of the machine in response to an operator experience level.

31. The machine of claim 29, wherein the at least one sensor is a fluid pressure sensor, a work tool position sensor, or a fluid flow sensor.

32. The machine of claim 29, further including an electric control configured to alter the operation of the work tool in response to the new application of the work tool.

* * * * *